United States Patent [19]

Linde et al.

[11] Patent Number: 4,778,220

[45] Date of Patent: Oct. 18, 1988

[54] TUNNEL DRIVING APPARATUS

[76] Inventors: Klaus Linde, Luisenstrasse 13, 4670 Lünen; Josef Klüsener, Am Südtor 4, 4709 Bergkamen-Oberaden, both of Fed. Rep. of Germany

[21] Appl. No.: 941,500

[22] Filed: Dec. 15, 1986

[30] Foreign Application Priority Data

Dec. 21, 1985 [DE] Fed. Rep. of Germany ..... 3545765

[51] Int. Cl.[4] ..... E21D 9/08

[52] U.S. Cl. ..... 299/33; 405/138

[58] Field of Search ..... 299/31, 33; 405/138, 405/141, 142, 143; 175/62

[56] References Cited

U.S. PATENT DOCUMENTS

| | | | |
|---|---|---|---|
| 1,766,568 | 6/1930 | Updegraff | 405/141 |
| 3,630,574 | 12/1971 | Cox et al. | 299/33 X |
| 3,695,720 | 10/1972 | Bolotin et al. | 299/33 |
| 3,861,750 | 1/1975 | Follert et al. | 299/33 |
| 4,474,494 | 10/1984 | Stuckmann et al. | 405/143 |

FOREIGN PATENT DOCUMENTS

| | | |
|---|---|---|
| 1534605 | 5/1971 | Fed. Rep. of Germany . |
| 2461240 | 7/1971 | Fed. Rep. of Germany . |
| 2504370 | 3/1977 | Fed. Rep. of Germany . |
| 2262388 | 7/1977 | Fed. Rep. of Germany . |
| 2020320 | 12/1977 | Fed. Rep. of Germany . |
| 3151060 | 7/1983 | Fed. Rep. of Germany . |
| 3133956 | 10/1983 | Fed. Rep. of Germany . |
| 2952529 | 9/1984 | Fed. Rep. of Germany . |
| 2755421 | 11/1985 | Fed. Rep. of Germany . |

*Primary Examiner*—George A. Suchfield
*Assistant Examiner*—David J. Bagnell
*Attorney, Agent, or Firm*—Sughrue, Mion, Macpeak & Seas

[57] ABSTRACT

Tunnel driving apparatus includes a full-face cutting machine 2 mounted, preferably vertically and laterally pivotably, in a drive shield 1. The cutting machine is displaceable, by means of feed rams 16, towards a working face. The cylinders 19 of the feed rams are secured to the machine body 3 of the full-face cutting machine, and act as guide shoes for slidably supporting the cutting machine on guide rails 6 fixed to the drive shield.

10 Claims, 2 Drawing Sheets

TUNNEL DRIVING APPARATUS

BACKGROUND OF THE INVENTION

This invention relates to a tunnel driving apparatus having a cutting machine mounted within a drive shield.

In a known type of driving apparatus (see DE-OS No. 2 504 369), the cutting machine can be moved within the drive shield, by means of hydraulic feed rams, towards and away from the working face. The entire cutting machine is displaceably supported and guided by means of guide shoes on two guide rails, the guide rails being vertically pivotably suspended within the drive shield at their forward ends by means of pivot joints, and being connected at their rear ends by a transverse yoke to form a U-shaped guide frame. Hydraulic control rams act on this guide frame in order to pivot the cutting machine. The cutting machine has an excessive overall length, particularly where it is a full-face cutting machine. Indeed, together with the guide rails, it extends out beyond the rear of the drive shield into the tunnel roadway, the drive system of the cutting machine and the control rams being situated in the tunnel roadway. The feed rams, which are arranged in the interior of the guide rails, are likewise situated in the tunnel roadway.

The object of the invention is to provide a driving apparatus with a simple construction, and with a short and compact cutting machine which can be entirely housed in the drive shield.

SUMMARY OF THE INVENTION

The present invention provides driving apparatus comprising a drive shield, and a cutting machine mounted within the drive shield, the cutting machine being slidebly guided on guide rails fixed to the drive shield, the cutting machine being movable along the guide rails by means of hydraulic feed rams, wherein the cylinders of the feed rams are fixed to the cutting machine and act as guide shoes slidably guiding the cutting machine on the guide rails.

Thus, the cylinders of the feed rams are formed as guide shoes, that is to say as fixed guide extensions of the cutting machine. These guide shoes slidably support the machine on the guide rails for movement towards, and away from, the working face. The feed rams, whose piston rods point towards the rear end of the shield, can be positioned relatively far forward within the drive shield, whereby a relatively short shield length can be used. The entire cutting machine, together with its feed rams and the guide rails, can be accommodated in the interior of the shield, even in the case of a drive shield having a relatively short overall length.

In a preferred embodiment, the drive shield is provided with two diametrically-opposed guide rails, and the cutting machine is movable along the guide rails by means of two diametrically-opposed feed rams. Advantageously, the cutting machine has a cutting head supported by a machine body, the feed rams being fixed to the machine body. With regard to their bearing and guide functions, the cylinder of each feed ram expediently has a rectangular, preferably square, cross-section. Alternatively, the cylinders of the feed rams can each be arranged in a housing which has a generally rectangular, preferably square, cross-section.

Preferably, each of the guide rails is of U-shaped cross-section.

Advantageously, the rear ends of the guide rails are connected by a yoke, the guide rails and the yoke defining a generally U-shaped frame, and the piston rods of the feed rams being attached to the yoke. Preferably, the cylinder of each feed ram is provided with a wear plate.

In order to render directional control possible, the cutting machine is pivotably mounted within the drive shield, so that it can be pivoted by means of control rams in the vertical and lateral directions, as known from DE-OS No. 2 504 369 and DE-AS No. 2 234 965. Preferably, each guide rail has a pivot piece provided with a domed bearing surface, the pivot piece of each guide rail being pivotably mounted in a respective cup-shaped bearing piece fixed to the inside of the drive shield, and wherein each pivot piece is pivotably connected to its guide rail by a respective pivot joint, the arrangement being such that the guide frame can pivot relative to the drive shield about two axes each of which is at right-angles to the central longitudinal axis of the drive shield. Advantageously, the apparatus further comprises control rams for pivoting the guide frame about said two axes, the control rams acting on the yoke of the guide frame.

BRIEF DESCRIPTION OF THE DRAWINGS

A tunnel driving apparatus constructed in accordance with the invention will now be described, by way of example, with reference to the accompanying drawings, in which.

DESCRIPTION OF PREFERRED EMBODIMENT

Figure 1:
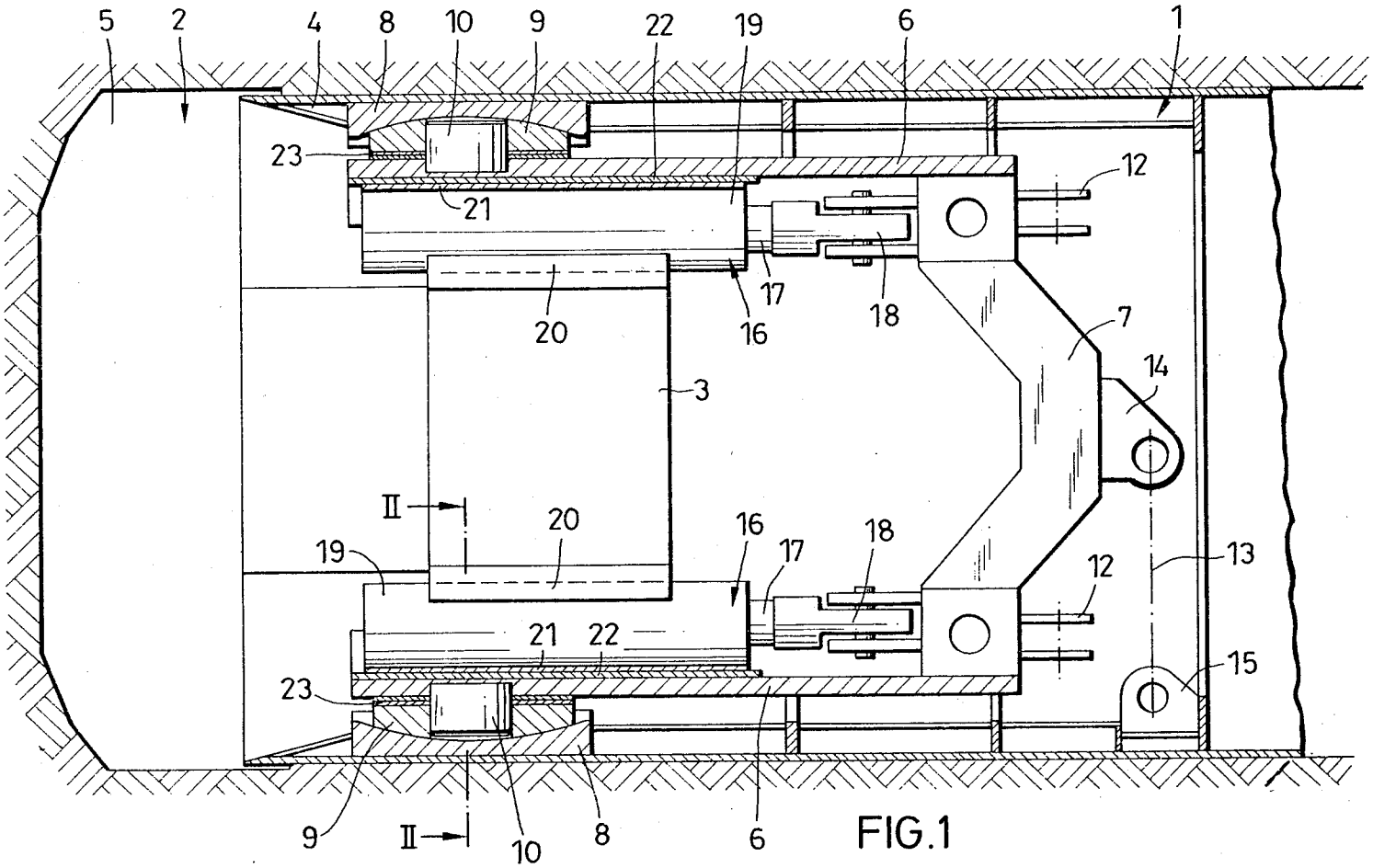
FIG. 1 is a horizontal longitudinal cross-section taken through the driving apparatus.

Referring to the drawings, a tunnel driving apparatus comprises a cylindrical drive shield 1, and a full-face cutting machine 2 mounted within the shield, the full-face cutting machine being shown only diagrammatically. The cutting machine 2 has a machine body 3 mounted within the drive shield 1, the machine body supporting a cutting head 5 which works in front of a cutting edge 4 of the drive shield, the cutting head carrying out a rotating movement or an oscillatory/-rotating movement about the machine and shield axis.

The entire full-face cutting machine 2 is displaceably mounted inside the cylindrical drive shield 1 on two guide rails 6. The guide rails 6 are arranged, one on either side of the machine body 3, at mid-shield height.

The rear ends of the rails 6 are interconnected by a stout yoke 7, thereby defining a generally U-shaped guide frame. The entire guide frame is mounted for vertical and horizontal pivotal movement with respect to the drive shield 1. For this purpose, cup-shaped bearing pieces 8 are secured to the internal surface of the drive shield 1 at diametrically opposed locations, the bearing pieces being associated with complementary pivot pieces 9 attached to the guide rails 6. The pivot pieces 9 have domed bearing surface which are complementary to the cup-shaped bearing pieces 8. The pivot pieces 9 are mounted for pivotal movement, in the horizontal plane, in the bearing pieces 8. Each guide rail 6 is provided with a pivot journal 10 in the vicinity of its forward (face-side) end, each pivot journal engaging in a pivot journal bore 11 of a respective pivot piece 9 (see FIG. 2). The pivot journals lie on a common axis extending at right-angles to the shield axis, so that the U-shaped guide frame formed by the guide rails 6 and the transverse yoke 7 is mounted for vertical pivotal movement in the drive shield 1 by means of the pivot journals. Vertical pivoting of the guide frame is carried out by means of hydraulic control rams (not shown), which are attached to pivot joints 12 provided on the transverse yoke 7, and which are supported in the rearward region on the drive shield 1. Lateral pivoting of the guide frame is effected with the aid of a separate hydraulic control ram (not shown), the axis of which is indicated at 13 in FIG. 1, this control ram being connected via pivot joints to a bracket 14 fixed to the transverse yoke 7 and to a bracket 15 fixed to the shield 1. Thus, with the aid of the control rams, the U-shaped guide frame (and hence the full-face cutting machine 2 mounted on it) can be pivoted in all directions.

The full-face cutting machine 2 is displaceable in relation to the guide frame (and hence the drive shield 1), towards and away from the working face, by means of two hydraulic feed rams 16 which are arranged on both sides of the machine body 3. Each feed ram 16 has its piston rod 17 pointing towards the rear of the shield 1, the piston rods being attached to the transverse yoke 7 by means of pivot joints 18. The cylinders 19 of the feed rams 16 are fixed to the machine body 3, and act as guide shoes for supporting and guiding the full-face cutting machine 2 of the guide rails 6.

Figure 2:
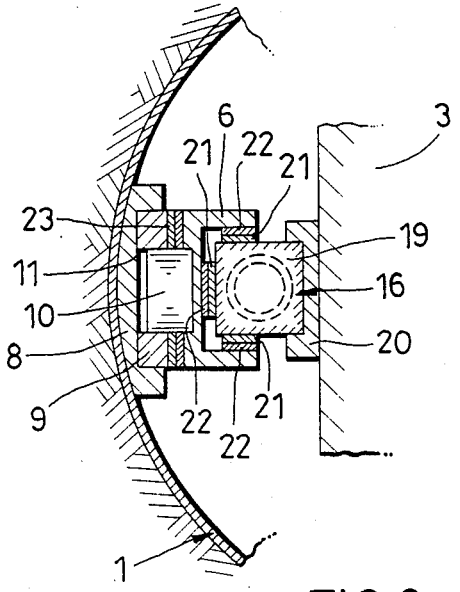
FIG. 2 is a cross-section taken on the line II—II of FIG. 1.

As shown best in FIG. 2, the guide rails 6 are of U-shaped section. The cylinders 19 of the feed rams 16 are of generally rectangular or square cross-section, and are slidably guided in the U-shaped guide rails 6. The cylinders 19 are connected to the machine body 3 by means of connectors 20 which grip the cylinders 19 on three sides, the cylinders being welded to the connectors.

The outer surfaces of the cylinders 19 which lie at right-angles to one another are provided with wear plates 21, by means of which they are internally guided on the two legs and the cross-piece of the U-shaped guide rails 6. The legs and cross-pieces of the U-shaped guide rails are also provided with wear-resistant plates 22. Moreover, wear plates 23 are arranged on the surfaces of the guide rails 6 and the pivot pieces 9 which slide on one another.

As mentioned above, the cylinders 19 of the feed rams 16 act as guide shoes (or slide blocks) whereby the full-face cutting machine 2 is slidably supported on the guide rails 6 and thus inside the drive shield 1. As shown, the feed rams 16 are positioned relatively far forward within the drive shield 1, and a short and compact machine mouting is achieved.

It will be apparent that the apparatus described above could be modified in a number of ways. For example, the cylinders 19 of the feed rams 16 could each be mounted in a housing, for example a jacket tube, which has a rectangular or square external cross-section, these housings being used to connect the feed rams to the machine body 3 of the full-face cutting machine 2.

We claim:

1. A tunnel driving apparatus, comprising:

(a) an elongate drive shield (1), (b) a cutting machine (2) disposed within the drive shield, (c) at least two guide rails (6) mounted to the drive shield generally parallel to a longitudinal axis thereof, and (d) at least two hydraulic feed rams (16) having cylinders (19) individually:

(1) fixed to the cutting machine, and (2) slidably cooperable with the guide rails such that the feed ram cylinders serve as guide shoes to slidably couple the cutting machine to the guide rails for bidirectional movement therealong upon the extension/retraction of the feed rams.

2. An apparatus according to claim 1, wherein the drive shield is provided with two diametrically-opposed guide rails, and wherein the cutting machine is movable along the guide rails by means of two diametrically-opposed feed rams.

3. An apparatus according to claim 2, further comprising a yoke (7) connected between rear ends of the guide rails, the guide rails and the yoke defining a generally U-shaped guide frame, and means (18) attaching piston rods (17) of the feed rams to the yoke.

4. An apparatus according to claim 3, wherein the guide frame is pivotally mounted within the drive shield.

5. An apparatus according to claim 4, wherein each guide rail has a pivot piece (9) provided with a domed bearing surface, the pivot piece of each guide rail being pivotably mounted in a respective cup-shaped bearing piece (8) fixed to the inside of the drive shield, and wherein each pivot piece is pivotably connected to its guide rail by a respective pivot journal (10), the arrangement being such that the guide frame can pivot relative to the drive shield about two axes each of which is at right-angles to the central longitudinal axis of the drive shield.

6. An apparatus according to claim 5, further comprising control rams (12, 13) for pivoting the guide frame about said two axes, the control rams acting on the yoke of the guide frame.

7. An apparatus according to claim 1, wherein the cutting machine has a cutting head supported by a machine body (3), the feed ram cylinders being fixed to the machine body.

8. An apparatus according to claim 1, wherein the cylinder (19) of each feed ram has a rectangular cross-section.

9. An apparatus according to claim 1, wherein each of the guide rails is of U-shaped cross-section.

10. An apparatus according to claim 1, wherein the cylinder of each feed ram is provided with a wear plate (21).

* * * * *